US007221374B2

(12) United States Patent
Dixon

(10) Patent No.: US 7,221,374 B2
(45) Date of Patent: May 22, 2007

(54) ADJUSTMENT OF COLOR IN DISPLAYED IMAGES BASED ON IDENTIFICATION OF AMBIENT LIGHT SOURCES

(75) Inventor: Brian S. Dixon, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 484 days.

(21) Appl. No.: 10/690,784

(22) Filed: Oct. 21, 2003

(65) Prior Publication Data

US 2005/0083293 A1 Apr. 21, 2005

(51) Int. Cl.
*G09G 5/02* (2006.01)

(52) U.S. Cl. ..... 345/591; 345/589

(58) Field of Classification Search ..... 345/1.1, 345/102, 207, 589–59, 600–602; 348/602, 348/223, 222.1, 223.1, 227.1, 366; 396/155; 395/155

See application file for complete search history.

(56) References Cited

U.S. PATENT DOCUMENTS 4,589,022 A 5/1986 Prince et al.
4,829,327 A 5/1989 Grunwald
4,997,271 A 3/1991 Shanks
5,379,083 A 1/1995 Tomita
5,803,570 A 9/1998 Chen et al.
6,346,933 B1 2/2002 Lin
6,412,956 B2 7/2002 Fujita et al.
6,530,666 B1 3/2003 Smith et al.
6,765,585 B2 * 7/2004 Wada ..... 345/589
2002/0051001 A1 5/2002 Kanai
2002/0113881 A1 * 8/2002 Funston et al. ..... 348/223
2002/0118967 A1 * 8/2002 Funston ..... 396/155
2003/0020725 A1 * 1/2003 Matsuda ..... 345/600
2003/0231260 A1 * 12/2003 Pate et al. ..... 348/602
2003/0234785 A1 * 12/2003 Matsuda et al. ..... 345/589
2004/0008288 A1 * 1/2004 Pate et al. ..... 348/602
2004/0196250 A1 * 10/2004 Mehrotra et al. ..... 345/102
2004/0212546 A1 * 10/2004 Dixon et al. ..... 345/1.1

* cited by examiner

*Primary Examiner*—David L. Lewis

(57) ABSTRACT

A method for adjusting color of images displayed in ambient light. A signal may be sensed from a plurality of spectral regions of an ambient light source to define a sensed signature of the ambient light source. The sensed signature may be compared to predetermined signatures of candidate light sources to identify a candidate light source that corresponds to the ambient light source. Images may be created so that the images are modified by a predefined color adjustment for the candidate light source identified.

30 Claims, 4 Drawing Sheets

ADJUSTMENT OF COLOR IN DISPLAYED IMAGES BASED ON IDENTIFICATION OF AMBIENT LIGHT SOURCES

BACKGROUND

Image display devices, such as projectors, rely on the additive properties of light to create colors in displayed images. Such devices generally project light of three or more different wavelengths or wavelength-ranges (such as red, green, and blue) onto a viewing surface in appropriate proportions to create a gamut of many colors perceived by a person viewing the surface (the viewer). However, ambient light also may combine additively with the projected light at the viewer's retina to alter the viewer's color perception of the projected light.

The ambient light may reduce and/or imbalance the gamut of colors perceived by the viewer. For example, displayed colors may be compressed into a reduced gamut, so that colors intended to be distinct are perceived as similar. Differentiating these colors in such a system becomes difficult. Such changes in perceived colors in response to ambient light are termed flare. Colors that are nearer white, that is, high lightness colors, may be more prone to flare, because their perception is more sensitive to any change in the white point of displayed images produced by ambient light. Furthermore, flare tends to be more pronounced in additive color display systems relative to subtractive systems, such as printers.

One approach to correcting color in displayed images may involve sensing the color of ambient light (its white point). The sensed white point of ambient light may suggest a suitable color correction to be applied to the images. Nevertheless, directly sensing the white point may have a number of potential disadvantages. In some cases, simple sensors may be employed to estimate the white point based on a small number of optical measurements. However, these simple sensors may provide a white point estimate that is too inaccurate. Alternatively, more sophisticated sensors may be used to provide a more accurate white point measurement from ambient light. However, these more sophisticated sensors may be too expensive to implement in most image display systems. In addition, even accurate white point information for ambient light may not be sufficient to select a color correction in some cases. For example, light sources with similar white points may have distinct spectral power distributions that interact differently with the surround within a display system.

SUMMARY

A method is provided for adjusting color of images displayed in ambient light. A signal may be sensed from a plurality of spectral regions of an ambient light source to define a sensed signature of the ambient light source. The sensed signature may be compared to predetermined signatures of candidate light sources to identify a candidate light source that corresponds to the ambient light source. Images may be created so that the images are modified by a predefined color adjustment for the candidate light source identified.

DETAILED DESCRIPTION

Figure 1:
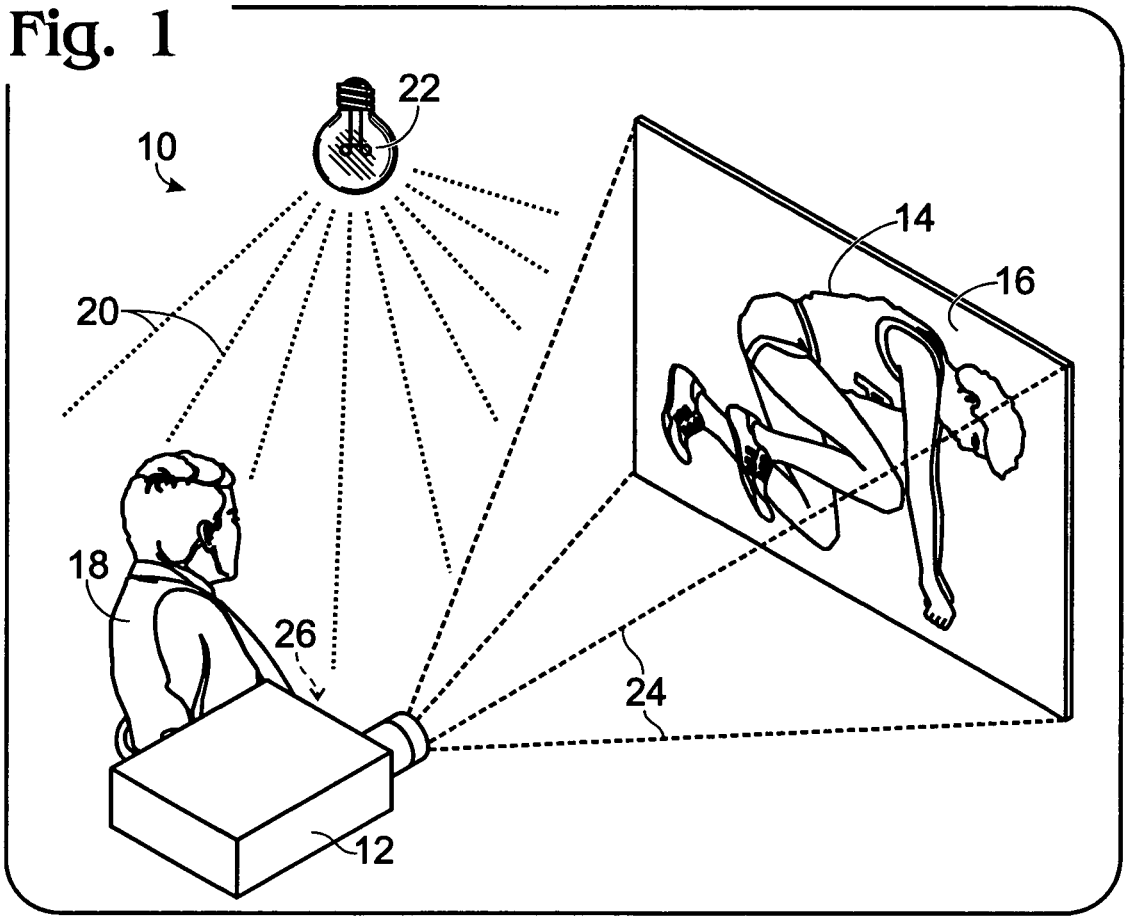
FIG. 1 is a view of a system for displaying images and adjusting the color of the displayed images based on identification of an ambient light source, in accordance with an embodiment of the invention.

FIG. 1 shows a display system 10 for displaying images and adjusting the color of the displayed images based on an ambient light source that the system identifies. System 10 may include a display device 12 that displays a plurality of images, such as currently displayed image 14, on a surface 16. System 10 also may include a viewer 18 positioned to view image 14 in ambient light 20 produced by ambient light source 22. Ambient light 20 may combine with displayed light 24 from the display device to alter how viewer 18 perceives the color of the images.

Display device 12 may include a light sensor 26 configured to sense the ambient light source. Based on sensing the ambient light source, the display device may identify the ambient light source according to its type and/or technology. A color adjustment suitable for the type/technology of the ambient light source then may be applied to the images by the display device before and/or as the images are created, to improve color rendition of the images. Identification of the ambient light source may enable improved color adjustment of displayed images.

Display device 12 may include any optical device configured to display visible images based on digital and/or analog representations of the images. The display device preferably displays color images that are created by additively combining light of different wavelengths in a spatial pattern for the viewer. Exemplary additive display devices include projectors, monitors, and/or televisions, among others. Projectors may project light to viewing surface 16, which reflects the light to the viewer. Monitors and non-projection televisions, for example, may transmit light from suitable color emitters, such as phosphors, to the eyes of a viewer, generally without substantial reflection.

Image 14 may be any optically formed counterpart of a stored image representation. Image 14 may be displayed as a recognizable discrete unit, for example, as part of a slide show (photographs, graphics, drawings, and/or the like), or may be part of a set of images displayed in rapid succession (such as a motion picture, a home movie, a television show, an animated cartoon, etc.), among others. Image 14 may be created from a digital file and/or an analog storage medium (such as tape or film), among others. Images are considered to be created when they are converted from a stored representation to an optical form presented to the viewer, for example, after their light components are reflected from surface 16. Accordingly, any color adjustment applied to an image electronically or optically, may be applied before (for example, by digital or analog manipulation) and/or as the image is created (for example, by optical manipulation, such as with an optical filter).

Surface 16 is any viewing site from which displayed light 24 produced by the display device is directed to a viewer's eyes. Exemplary viewing surfaces may include a reflective surface, a screen, a wall, an array of light-emitting diodes or phosphors, and/or the like.

Viewer 18 may include any person that can see the images. Viewer 18 may be one person or a group of people.

Ambient light source 22 may be any light source(s) that introduces light into the display system, other than displayed light 24 created by display device 12. Accordingly, the ambient light source may provide natural or artificial light. Exemplary ambient light sources include the sun, incandescent light sources, fluorescent light sources (such as warm white, cool white, etc.), hybrid incandescent-fluorescent light sources, light-emitting diodes, and\or high-intensity discharge light sources (such as those produced using high pressure sodium, low pressure sodium, mercury, metal halide, etc.).

A display device may provide displayed light 24 by additively combining any suitable number of colors, and thus is not limited to three primary colors. For example, a display device may additively combine red, green, blue, cyan, magenta (band rejection in middle frequencies), yellow, and white light. Additive combination of greater than three colors may provide an advantage, for example, by extending the display gamut outside of a gamut defined by red, green, and blue light only.

Light sensor 26 may include any device that detects a property of light, generally by producing or modifying electrical signals in response to light exposure. Exemplary light sensors may include photomultiplier tubes, photodiodes, photoresistors, and/or the like. Light sensor 26 may be selectively responsive to particular wavelengths or spectral regions of light, based on the configuration of the sensor itself or based on selective exposure of the sensor to particular spectral regions of ambient light, such as by filtering ambient light with optics. Sensor 26 may be a single sensor with a plurality of filter optics for selectively exposing the sensor to different spectral regions of light. Alternatively, sensor 26 may be a plurality of two or more light sensors or sensor elements that may operate serially and/or in parallel, for example, to measure the intensity of different spectral regions of ambient light in sequence or concurrently, respectively. Further aspects of spectral regions that may be sensed by light sensor 26 are described below in relation to FIGS. 3–5.

Light sensor 26 may have any suitable fixed or variable position relative to the body of display device 12. In some embodiments, the light sensor may have a position defined completely by the display device, for example, the light sensor may be fixed to the housing of the display device. Alternatively, the light sensor may be pivotable and/or movable translationally relative to the display device. For example, the light sensor may be pivotable to allow the viewer to orient the light sensor toward an ambient light source or any suitable surface in the display system. In some embodiments, the light sensor may be coupled to the display device with a communications link to enable, for example, more flexible positioning of the light sensor. The communications link may provide any suitable form of coupling, for example, electrical communication (such as with wires), electromagnetic communication (such as with visible light, infrared light, radiowaves, microwaves, etc.), ultrasonic communication, and/or the like.

Figure 2:
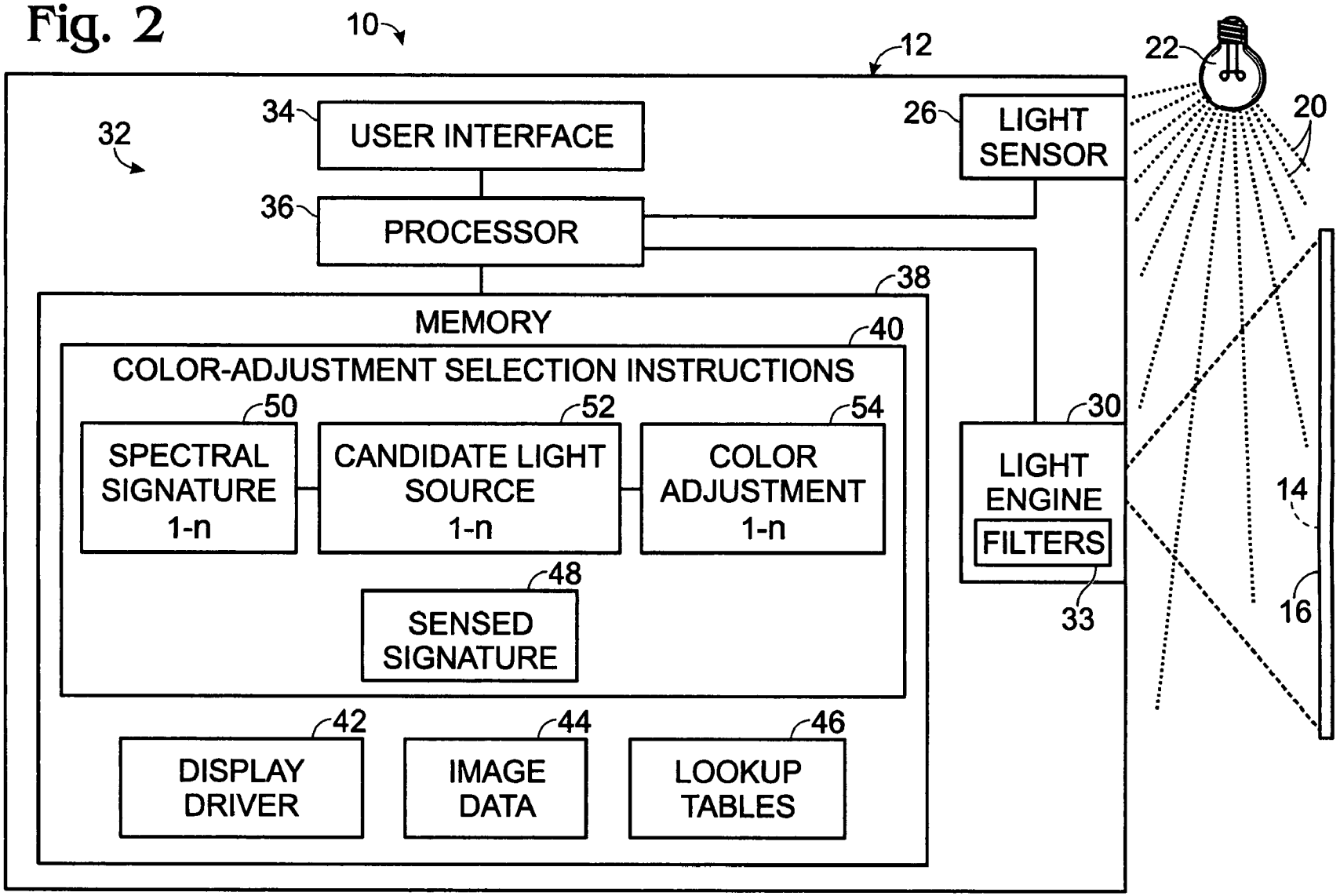
FIG. 2 is a schematic view of the system of FIG. 1.

FIG. 2 shows a schematic view of display system 10. Display device 12 of system 10 may include, but is not limited to, a light engine 30, a controller 32 configured to control operation of the light engine, and light sensor 26 described above. Display device 12, particularly controller 32, also may include interface circuitry (not shown), for example, signal conversion devices that may be utilized for color adjustment/correction (such as digital-to-analog conversion, analog-to-digital conversion, a color difference signal designation (such as luminance (Y), a scaled blue-yellow color difference signal (Pb), and a scaled red and yellow color difference signal (Pr), or "YPbPr") to RGB (red, green, blue), etc).

Light engine 30 may create displayed images from corresponding digital image files (or analog storage media). Creating or displaying may include any electrical and/or optical operation that converts a stored image representation, such as image data, to an image that is visible to the viewer. The light engine may include a display light source and optics. Any suitable display light source or set of sources may be used, including an incandescent lamp(s), a high-intensity discharge lamp(s), a fluorescent lamp, a light-emitting diode(s), fluorescent materials, phosphorescent materials, and/or the like. Exemplary display light sources may include a metal halide lamp or a tungsten lamp. The optics generally include any optical mechanisms configured to modify light from the display light source to produce displayed images. The optical mechanisms may act by reflection, refraction, diffraction, polarization, filtering, and/or scattering, among others. Accordingly, the optical mechanisms may include lenses, mirrors, filters, gratings, prisms, liquid-crystal displays, etc. In particular, the optical mechanisms may include a set of filters 33 that may be selectively placed in position for modifying images as they are being created, to apply a selected color adjustment to the images.

In exemplary embodiments, the optical mechanisms receive a broad spectral distribution of light from the display light source, and resolve the light with a prism and mirrors, or with a revolving filter wheel, into different light components. These light components may correspond generally to colored light that is red, green, and blue (or may have any other suitable number of additive color components). With three primary color components, for example, displayed images may be created by transmitting the light through liquid crystal displays, forming red, green, or blue portions of images to be displayed. Alternatively, displayed images may be produced by sending each of the lights to a processor-controlled micro-mirror array, or by any other suitable mechanism or set of mechanisms.

The display device may display different colored portions of each image sequentially or in parallel to create the image. With sequential display, the different colored portions may be combined additively within the visual system of the viewer. With parallel display, different colored portions of an image may be projected to the viewing surface at the same time. This may be performed, for example, with a plurality of display elements, each projecting an image aligned to illuminate the same region of the viewing surface, for example, as in a theater. Alternatively, a plurality of color-separated images may be combined onto a single display element (for example, a liquid-crystal display, a micro-mirror, etc.) at the same time.

Controller 32 may be any mechanism or set of mechanisms that defines the content of images displayed by light engine 30. Accordingly, the controller may receive, manipulate, and store digital and/or analog image representations and other data relating to manipulation of the image representations, for example, sensed data from light sensor 26 and color adjustment instructions.

Controller 32 may include, but is not limited to, a user interface 34, a processor 36, and memory 38. These and other mechanisms of the controller may be included in a single apparatus, for example, integrated with the light engine, or may be distributed between two or more coupled apparatus.

User interface 34 may be any mechanism for receiving inputs from viewer 18. The user interface may include a keyboard, a mouse, a keypad, a touch screen, etc. The user interface may be used, for example, to start/stop display of images, to set display preferences, and/or as a part of a setup procedure, for example, to tune the gain and/or offset of analog/digital converters. Alternatively, or in addition, the user interface may be used to initiate selection of a suitable color adjustment to be applied to images before or as they are created, based on sensing ambient light. In some embodiments, activation of light sensor 26 and/or initiation of color adjustment selection may be performed automatically, such as each time the display device is powered on, at preset intervals, when ambient light is sensed to have changed by a threshold amount, etc.

Processor 36 may be any device capable of receiving data from light sensor 26, user interface 34, and memory 38, and of performing digital manipulation of such data, such as arithmetic and logic operations, among others. These digital manipulations may create instructions for use by the light engine to create images.

Memory 38 may be virtually any mechanism for storing data, including, but not limited to ROM (such as EEPROM or flash memory), RAM, film, tape, and/or other magnetic, electronic, and/or optical storage device(s) or media. The memory may include, but is not limited to, color-adjustment selection instructions 40, a display driver 42, image data 44, and lookup tables 46.

Display driver 42 may be any hardware, software, or firmware configured to convert image data 44 into display data that controls and/or is used by light engine 30 to create corresponding displayed images. Accordingly, the display driver may translate image data from a device-independent color space to the color values of the display device. Alternatively, or in addition, the display driver may convert color values into images displayed on liquid-crystal displays or into instructions that control or are recognized by a micro-mirror array, among others.

Image data 44 generally includes digital or analog representations of any images to be displayed by the display devices. For example, the digital representations may be raster files that specify color values for each pixel or image element within an array of such pixels or elements. In exemplary embodiments, each pixel may have three color values associated with the pixel, corresponding to the level of red, green, and blue to be displayed by light engine 30. However, any other digital or analog representation may be suitable.

Color-adjustment selection instructions 40 may be any instructions, particularly digital instructions, that allow selection of a suitable color adjustment to be applied to images before or as they are created. Instructions 40 may direct comparison of a sensed signature 48, measured by light sensor 26, with a plurality (1 to n, with $n \geqq 2$) of predetermined signatures 50 from a corresponding number candidate light sources 52, which may be represented digitally. Each predetermined signature 50 and corresponding candidate light source 52 also may be associated with a predefined color adjustment 54 for that candidate light source. Accordingly, comparison of sensed signature 48 with predetermined signatures 50 may identify a candidate light source 52 having a predetermined signature that most closely corresponds to sensed signature 48. The color adjustment 54 associated with the candidate light source identified then may be applied to the images (or their image representations) before or as the images are created, to modify these images with the color adjustment. Sensed and predetermined signatures are described below in more detail in relation to FIGS. 3–5.

Color adjustment 54 may include any instructions that modify any aspect of the color of images created from digital image data or analog image representations. The modification may be any alteration of one or more colors within an image, produced before and/or during creation of the image. The modification may change the hue, lightness, and/or saturation of one or more of the image colors relative to an absence of the modification. Accordingly, application of different color adjustments may produce different changes to the hue, lightness, and/or saturation of one or more colors of the displayed images.

Color adjustment 54, also termed color tuning, may provide electronic modification and/or optical modification of image color. Electronic modification may include digital modification of digital image files that define how images are created and/or modification of analog electrical signals generated based on image representations. Optical modification of images may be conducted by modifying light as the images are being created by the light engine.

Digital and/or analog modification of image data may occur before and/or during implementation of the image data by light engine 30 to display corresponding color-adjusted images. Modification may be performed mathematically or logically, for example, with analog electronics or digital calculations, or using lookup tables 46 selected and used by particular color adjustments 54.

Digital modification may be implemented, for example, using hardware-, firmware-, or software-implemented lookup tables that re-map input color values for each color channel of image files to output color values that are used to create the corresponding color-adjusted images. The lookup tables may be one dimensional, for example, a lookup table to remap red input values to new red output values. One-dimensional lookup tables may allow relative offsets between various color channels to be adjusted. Alternatively, the lookup tables may be multi-dimensional, for example, three-dimensional. Three-dimensional lookup tables may allow, for example, each output color value to be defined as a function of three input color values. For example, red output values may be a function of red, green, and blue input values instead of just red input values, as with a one-dimensional lookup table. A three-dimensional lookup table for each output color channel may allow morphing a color gamut volume. Suitable lookup tables may be provided by a manufacturer of the display device, may be developed by an operator of the display device, may be provided by other sources, and/or the like. A color adjustment defined by a lookup table may be applied to a digital image file at any suitable time before and/or during creation of a displayed, color-adjusted image from the image file. Accordingly, the lookup table may be expressed in analog and/or digital space.

Alternatively, or in addition, color adjustment may be implemented by applying various forms of mathematical manipulations. For example, color values may be adjusted using matrix solutions, such as mathematical matrix multiplication of input triplet/RGB-vectors. Software or firmware may use logical and/or mathematical manipulation of input color values.

Alternatively, or in addition, digital (or analog) modification may include digital (or analog) re-adjustment of the displayed white point by providing global remapping (linear or nonlinear scaling) of one or more of the component color values that define each pixel. For example, if red values in the images can have values from 0–255 before white-point adjustment, each of these values may be mapped by the white-point adjustment to another range, such as 0–242, 0–230, etc. In this exemplary adjustment, the white point is shifted toward blue and green.

Optical modification of images may be produced using a selected color adjustment implemented with light engine 30, particularly the display light source, filters 33, or other optical elements. Accordingly, the optical instructions may modify (add, remove, and/or change) any suitable aspect(s) of the display light source(s) and/or optics.

Aspects of the display light source that may be modified include intensity of the source, type of light source, spectral power distribution of the light source, and/or the like. The intensity may be modified, for example, by increasing power to the display light source to increase its intensity and thus lessen the impact of an ambient light source. The type of display light source may be modified, for example, by selecting a different display light source for use in the light engine or by selecting a different combination of display light sources that function in the light engine. The spectral power distribution of the display light source may be modified, for example, by altering composition of a gas, a fluorophore, etc. included in the display light source.

Aspects of the optics that may be modified include the number, type, or efficiency of optical mechanisms in the light engine. Exemplary optical modifications may alter the spectral power distribution of light from the display light source, in a wavelength-selective fashion, for example, by adding, changing, and/or removing one or more of filters 33, such as a band-rejection filter or "slot" filter, a band pass filter, a low pass filter, a high pass filter, attenuators, etc. Alternatively, or in addition, optical modification may include changing a color wheel that produces color components from the display light source (field sequential systems). Such wavelength-selective filtering may be implemented at any suitable time, for example, before, during, and/or after resolving the light into color components. In exemplary embodiments, a filter may be used that removes light selectively from one or two of the color components of light. For example, in a particular exemplary embodiment in which images are formed from three color components, a blue light component may have a spectral distribution of about 380–510 nm, a green component about 465–585 nm, and a red component about 575–700 nm. A band rejection filter may be introduced that rejects light having wavelengths of about 570–590 nm. Accordingly, in this example, the red and green components are defined by narrower ranges of wavelengths, and the displayed gamut increases towards the original gamut (before combination with ambient light), or beyond the original gamut. In other embodiments, such a filter may be configured to remove light from any portion of the spectral distribution of one or more of the light components. A plurality of filters 33 may be used individually or in combination to apply a set of different color adjustments to an image as it is created. Filters 33 may be configured to correct particular conditions of flare, for example, based on a type and/or technology of an identified ambient light source.

A color adjustment that modifies the optics of the light engine may be combined with an electronic adjustment. For example, altering the spectral distribution of displayed light, such as with a band-rejection filter, as described above, may alter the white point of the display system. Accordingly, any suitable digital and/or analog modification(s) may be combined with any suitable optical modification(s).

Color-adjustment selection instructions may be configured to compare a sensed signature 48 with a set of (n) predetermined signatures 50. A signature, as used herein, may be any description of the relative and/or absolute power or intensity of the light source from a plurality of different spectral regions. Each spectral region may correspond to any wavelength, band of wavelengths, or set of wavelengths or bands). The spectral regions may be nonoverlapping or overlapping. The spectral regions may be of the same width or different widths.

The light source may be an ambient light source or a candidate light source. The ambient light source may be any light source (generally other than the display light source) that is operating within the proximity of the display system. The ambient light source may provide a sensed signature. A sensed signature is any signature sensed by a light sensor (or sensors) of the display device within the display system. A candidate light source is any predefined light source that may correspond to the ambient light source. The candidate light source may be analyzed prior to acquiring the sensed signature, to provide a predetermined signature. Similar to the sensed signature, the predetermined signature may be determined by measuring light intensity from a plurality of spectral regions for a candidate light source. The spectral regions used to create the predetermined signature may be identical to, overlapping with, or nonoverlapping with spectral regions from which the sensed signature of the ambient light source is measured. When nonoverlapping, the spectral regions used to create the predetermined signature may be adjacent to corresponding spectral regions for the sensed signature. Alternative to direct measurement, the predetermined signature may be estimated from other measurements, such as by interpolation, summation, averaging, etc.

Figure 3:
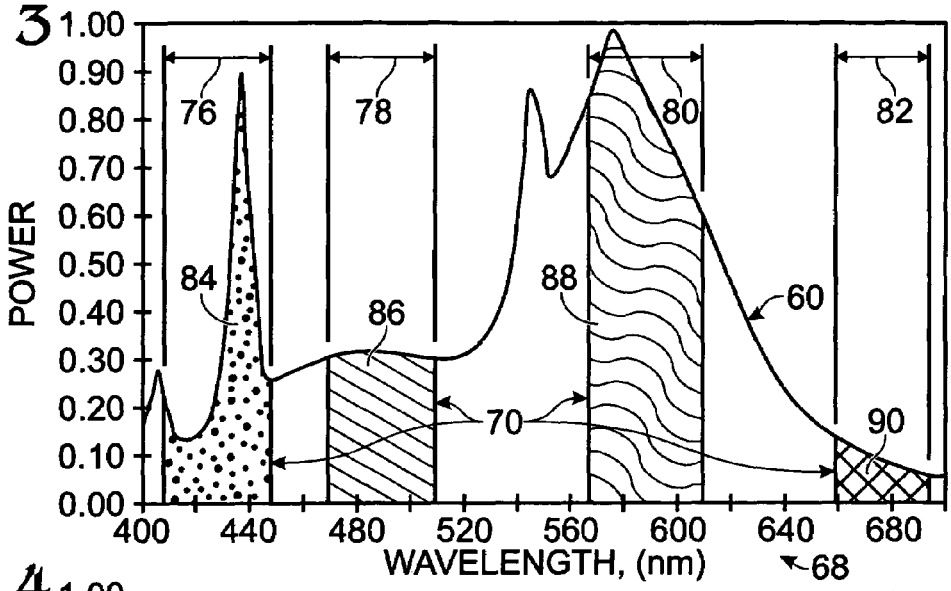
FIG. 3 is a graph of a spectral power distribution and a signature produced by a cool white fluorescent light source, in accordance with an embodiment of the invention.
Figure 4:
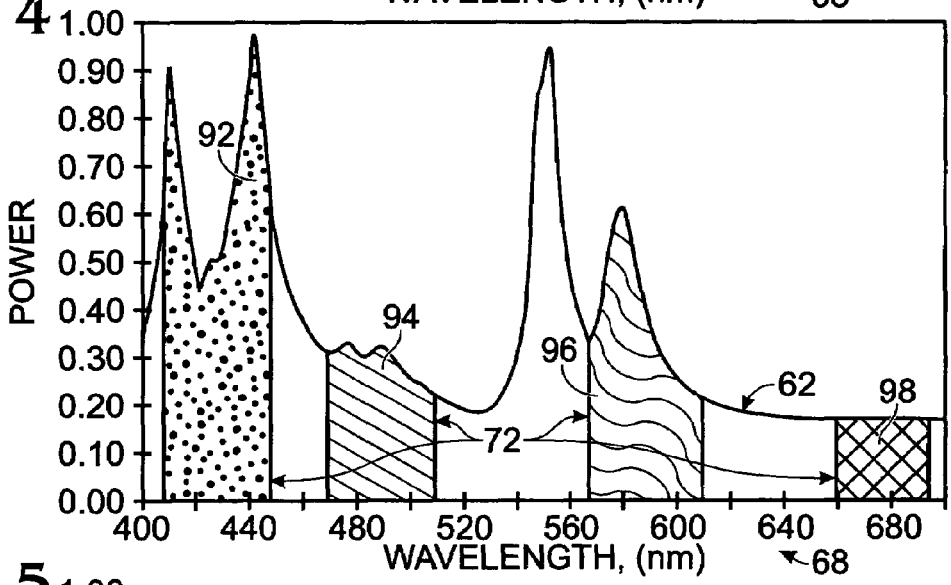
FIG. 4 is a graph of a spectral power distribution and a signature produced by a metal halide light source, in accordance with an embodiment of the invention.
Figure 5:
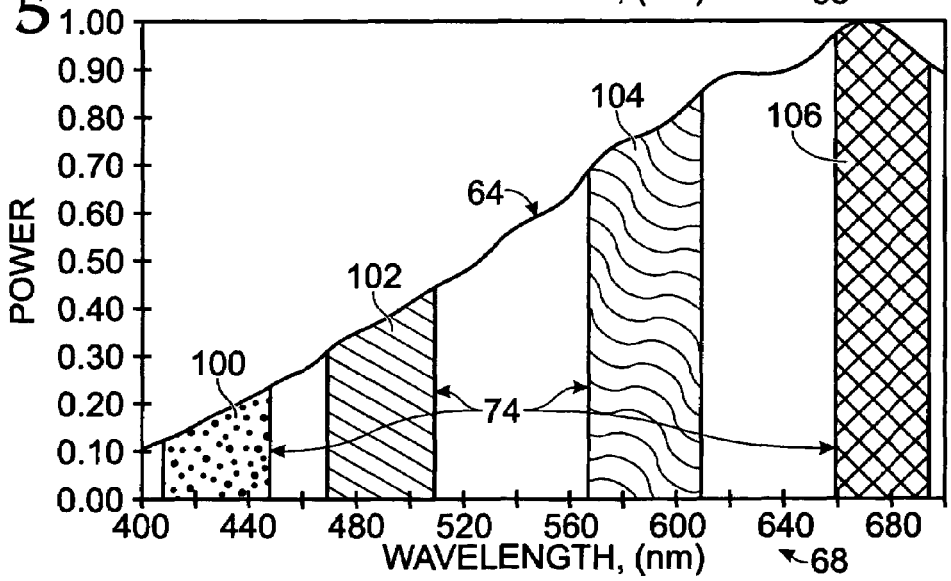
FIG. 5 is a graph of a spectral power distribution and a signature produced by a tungsten-based incandescent light source, in accordance with an embodiment of the invention.

FIGS. 3–5 show exemplary spectral power distributions 60, 62, 64 and signatures for three different light sources: a cool white fluorescent source, a metal halide source, and a tungsten-filament based source, respectively. Each graph plots the power or intensity of light produced by each light source, shown at 66, according to wavelength of the light, shown at 68.

Spectral power distributions 60, 62, 64 may appear quite complex, with numerous peaks and valleys. However, each light source may define a distinct signature 70, 72, 74 within the spectral power distribution that may be sensed wavelength bands 76, 78, 80, 82. In the present illustration, band 76 extends from about 408–457 nm, band 78 from about 468–508 nm, band 80 from about 567–610 nm, and band 82 from about 658–695 nm. Each band may define a corresponding spectral region from which an intensity may be measured or estimated. Accordingly, signature 70 may be defined by signals measured or estimated from two or more of spectral regions 84, 86, 88, 90; signature 72 may be defined by signals measured or estimated from two or more of spectral regions 92, 94, 96, 98; and signature 74 may be defined by signals measured or estimated from two or more of spectral regions 100, 102, 104, 106. Each signature may include absolute signals or relative signals, for example, by combining region intensities for a candidate light source as ratios.

Signatures 70, 72, 74 may correspond to predetermined signatures for candidate light sources. Accordingly, a sensed signature from an ambient light source may be compared to each of signatures 70, 72, 74 to identify one of the predetermined signatures to which the sensed signature most closely corresponds. Spectral regions may be selected to facilitate distinguishing different ambient light sources. For example, in the present illustration intensity signals measured from corresponding spectral regions 86, 94, 102 may be similar. Accordingly, these intensity signals may not be useful by themselves for distinguishing these light sources. However, these intensity signals may be used, for example, to normalize other measured intensity signals. For example, signals measured from corresponding spectral regions 90, 98, 106 are distinct for these three exemplary light sources. Accordingly, ratios with intensities measured from bands 78 and 82 for each candidate light source would create distinguishable signatures with intensities from only two spectral regions for each source. Any suitable number of spectral regions may be used, for example, to improve accuracy and to increase the number of candidate (and ambient) light sources that may be distinguished according to their signatures.

Figure 6:
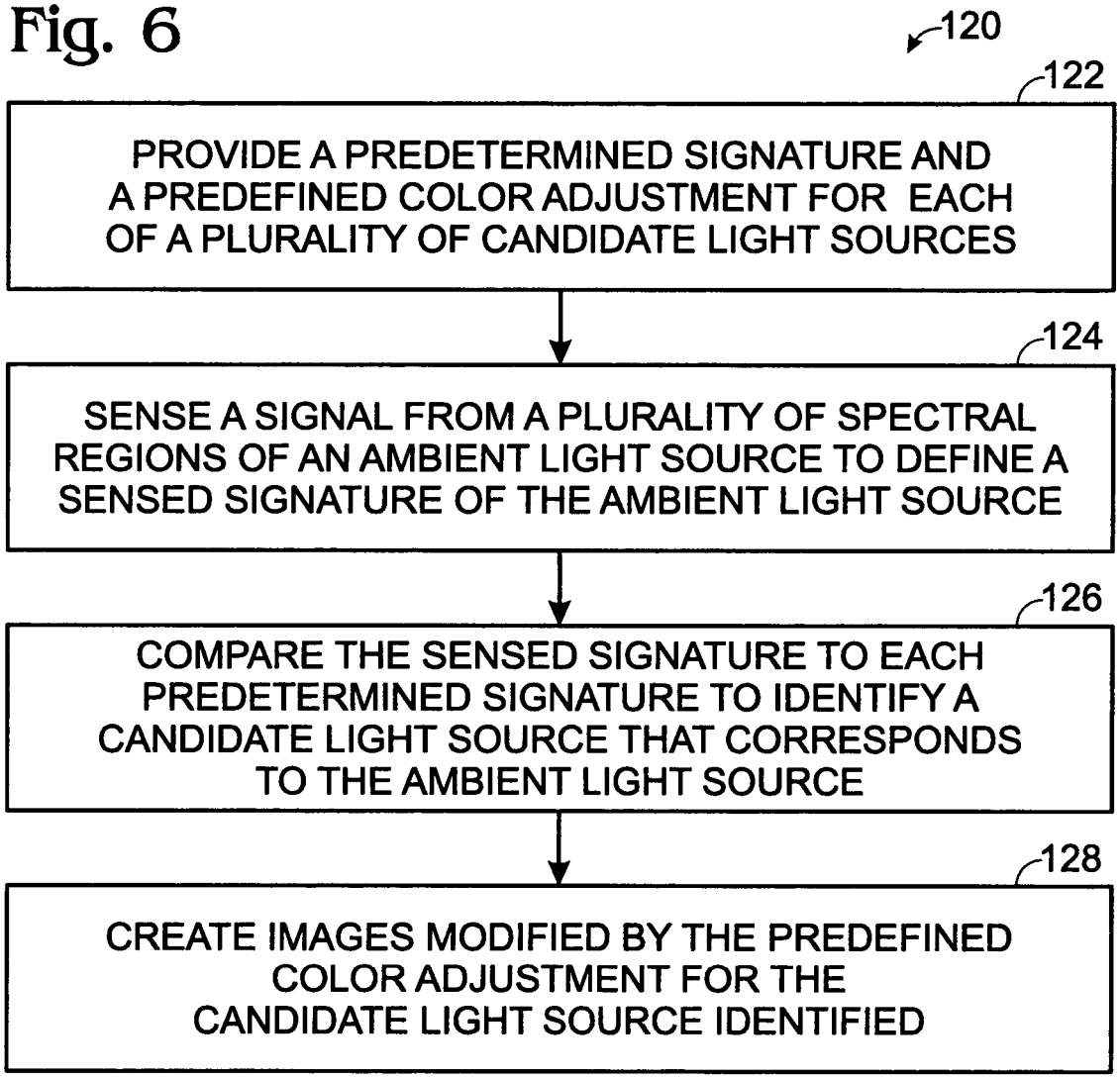
FIG. 6 is a flowchart of a method for adjusting color in displayed images based on identification of ambient light sources, in accordance with an embodiment of the invention.

FIG. 6 shows a method 120 of adjusting color in displayed images based on identification of an ambient light source.

Method 120 may include an operation of providing a predetermined signature and a predefined color adjustment for each of a plurality of candidate light sources, shown at 122. The predetermined signatures and/or predefined color adjustments may be provided by any suitable source, such as a person using the display system, a manufacturer of the display system, a person servicing the display system, and/or the like.

Method 120 may include sensing a signal from a plurality of spectral regions of an ambient light source to define a sensed signature of the ambient light source, shown at 124. The sensed signature may be defined at any suitable time before, during, and/or after use of the display system to display images.

Method 120 may include comparing the sensed signature to each predetermined signature to identify a candidate light source that corresponds to the ambient light source, shown at 126. Comparison may include direct numerical comparison of the sensed signature to each predetermined signature, or may include any other suitable mathematical analysis. In some embodiments, comparison may determine which of the predetermined signatures most closely corresponds to the sensed signature. Identification of the candidate light source may include selecting a color adjustment associated with the identified candidate light source.

Method 120 may include creating images modified by the predefined color adjustment for the candidate light source identified, shown at 128. The images may be created by any suitable display light source and optics and from any suitable image representations. The images may be modified by the predefined color adjustment before and/or during their creation form the image representations. For example, image data may be modified digitally prior to implementing the image data with a light engine, or modified optically as the light engine is creating the image.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various the claims recite "a" or "a first" element or the equivalent thereof, such claims should be understood to include incorporation of one or more such elements, neither requiring nor excluding two or more such elements.

What is claimed is:

1. A method of adjusting color of images displayed in ambient light, comprising:

sensing a signal from a plurality of spectral regions of ambient light to define a sensed signature of the ambient light;

comparing the sensed signature to predetermined signatures of light sources of different types to identify a type of light source that corresponds to the ambient light; and projecting light to create images modified by a predefined color adjustment for the type of light source identified, the predefined color adjustment being configured to reduce a change in color rendition introduced by the type of light source identified as corresponding to the ambient light.

2. The method of claim 1, which further comprises providing a predetermined signature and a predefined color adjustment for each type of light source.

3. The method of claim 2, wherein providing a predetermined signature includes providing data relating to intensity of a type of light source in each of the spectral regions for each of the different types of light sources.

4. The method of claim 2, wherein providing a predefined color adjustment includes defining one or more lookup tables for transformation of input color values to output color values, and wherein projecting light includes modifying input values from digital image files using the one or more lookup tables of the selected color adjustment.

5. The method of claim 4, wherein defining one or more lookup tables includes defining a three-dimensional lookup table configured to transform a plurality of input color values to a single output color value.

6. The method of claim 2, wherein providing a predefined color adjustment includes defining an optical modification of one or more light components used to create the images.

7. The method of claim 6, wherein defining an optical modification includes defining a filter through which one or more of the light components will be passed during projecting light.

8. The method of claim 1, wherein sensing a signal from a plurality of spectral regions includes 1) selecting only two spectral regions that in combination produce distinguishable signatures for each of the different types of light sources, and 2) sensing an intensity from each of the only two spectral regions.

9. The method of claim 1, wherein sensing a signal for a plurality of spectral regions includes sensing the signal for each of three or more spectral regions.

10. The method of claim 1, wherein comparing includes selecting a predetermined signature that most closely corresponds to a signal sensed for each of the spectral regions.

11. The method of claim 1, wherein projecting light includes projecting light onto a refelective vertical surface.

12. The method of claim 1, wherein projecting light includes 1) selecting image representations having data corresponding to the images created by projecting light, 2) modifying the data according to the predefined color adjustment, and 3) sending the data to a light engine after modifying.

13. The method of claim 12, wherein selecting image representations includes selecting digital image files.

14. A system for adjusting color of images displayed in ambient light, comprising:

a light engine configured to project light to create images from a set of image representations;

a light sensor for sensing a signal from each of a plurality of spectral regions of ambient light to define a sensed signature of the ambient light; and a controller in communication with the light sensor and the light engine, the controller having access to a predetermined signature and a predefined color adjustment for each of a plurality of different types of light sources, each predefined color adjustment being configured to reduce a change in color rendition introduced by a corresponding type of light source as ambient light, the controller being configured to compare the sensed signature to the predetermined signatures to identify a type of light source that corresponds to the ambient light, the controller also being configured to select a predefined color adjustment corresponding to the type of light source identified, the controller further being configured to modify each of the images created by the light engine with the predefined color adjustment for the type of light source identified as corresponding to the ambient light.

15. The system of claim 14, wherein the light sensor includes a plurality of filters that selectively permit light from each of the spectral regions to reach the light sensor.

16. The system of claim 14, wherein the light sensor includes a plurality of sensor elements, each sensor element of the plurality being configured to sense a different one of the spectral regions.

17. The system of claim 14, wherein the controller is configured to send instructions corresponding to the image representations to the light engine, and wherein the controller is configured to apply the selected color adjustment before sending.

18. The system of claim 17, wherein the image representations include image elements each having a plurality of input color values, and wherein the selected color adjustment defines a lockup table configured to relate the plurality of input color values to a single output color value for at least a subset of the image elements.

19. The system of claim 14, wherein the controller is configured to send instructions for optical modification of light components by the light engine, the optical modification including selecting a filter through which to pass one or more of the light components.

20. A program storage device readable by a processor, tangibly embodying a program of instructions executable by the processor to perform methods steps for adjusting color of images displayed in ambient light, the method steps comprising:

providing a predetermined signature and a predefined color adjustment for each of a plurality of different types of light sources, each predefined color adustment being configured to reduce a change in color rendition introduced by a correspondinp type of light source as ambient light;

sensing a signal from a plurality of spectral regions of ambient light to define a sensed signature of the ambient light;

comparing the sensed signature to each predetermined signature to identify a type of light source that corresponds to the ambient light, thereby selecting a color adjustment based on the type of light source identified; and projecting light to create images modified by the selected color adjustment.

21. The program storage device of claim 20, wherein providing a predetermined signature includes providing data relating to intensity of a type of light source in each of the spectral regions for each of the different types of light sources.

22. The program storage device of claim 20, wherein providing a predefined color adjustment includes defining one or more lockup tables for transformation of input color values to output color values, and wherein projecting light includes modifying input values from digital image files using the one or more lookup tables of the selected color adjustment.

23. The program storage device of claim 22, wherein defining a lockup table includes defining a three-dimensional lookup table configured to transform a plurality of input color values to a single output color value.

24. The program storage device of claim 20, wherein providing a predefined color adjustment includes defining an optical modification of one or more light components used to create the images.

25. The program storage device of claim 24, wherein defining an optical modification includes defining a filter through which one or more of the light components will be passed when projecting light.

26. The program storage device of claim 20, wherein sensing a signal from each of a plurality of spectral regions includes 1) selecting only two spectral regions that in combination produce distinguishable signatures for each of the different types of light sources, and 2) sensing an intensity from each of the only two spectral regions.

27. The program storage device of claim 20, wherein sensing a signal from a plurality of spectral regions includes sensing a signal for each of three or more spectral regions.

28. The program storage device of claim 20, wherein comparing includes selecting a predetermined signature that most closely corresponds to signals sensed from the spectral regions.

29. A system for adjusting color of images displayed in ambient light, comprising:

moans for sensing a signal from a plurality of spectral regions of ambient light to define a sensed signature of the ambient light;

means for comparing the sensed signature to predetermined signatures of different types of light sources to identify a type of light source that corresponds to the ambient light; and projecting light to create images modified by a predefined color adjustment for the type of light source identified, the predefined color adjustment being configured to reduce a change in color rendition introduced by the type of light source identified as corresponding to the ambient light.

30. The method of claim 1, wherein comparing includes comparing the sensed signature to predetermined signatures of different types of light sources selected from the group consisting of the sun, incandescent light sources, fluorescent light sources, hybrid incandescent-fluorescent light sources, light-emitting diodes, and high-intensity discharge light sources.

* * * * *

UNITED STATES PATENT AND TRADEMARK OFFICE

CERTIFICATE OF CORRECTION

PATENT NO. : 7,221,374 B2
APPLICATION NO. : 10/690784
DATED : May 22, 2007
INVENTOR(S) : Dixon It is certified that error appears in the above-identified patent and that said Letters Patent is hereby corrected as shown below:

In the Claims

Col. 11 (line 38), delete “lockup” and insert therefor --lookup--.

Col. 11 (line 53), delete “adustment” and insert therefor --adjustment--.

Col. 11 (line 55), delete “correspondinp” and insert therefor --corresponding--.

Col. 12 (line 10), delete “lockup” and insert therefor --lookup--.

Col. 12 (line 16), delete “lockup” and insert therefor --lookup--.

Col. 12 (line 42), delete “moans” and insert therefor --means--.

Signed and Sealed this

Thirteenth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,221,374 B2
APPLICATION NO. : 10/690784
DATED : May 22, 2007
INVENTOR(S) : Dixon It is certified that error appears in the above-identified patent and that said Letters Patent is hereby corrected as shown below:

In the Claims

Col. 11 (line 38), delete “lockup” and insert therefor --lookup--.

Col. 11 (line 53), delete “adustment” and insert therefor --adjustment--.

Col. 11 (line 55), delete “correspondinp” and insert therefor --corresponding--.

Col. 12 (line 10), delete “lockup” and insert therefor --lookup--.

Col. 12 (line 16), delete “lockup” and insert therefor --lookup--.

Col. 12 (line 42), delete “moans” and insert therefor --means--.

Signed and Sealed this

Twenty-seventh Day of November, 2007

JON W. DUDAS
*Director of the United States Patent and Trademark Office*